United States Patent [19]

Cremo

[11] 4,257,792

[45] Mar. 24, 1981

[54] STEAM-PRESSURED SMOKE ELIMINATOR FOR TALL SMOKE STACKS

[76] Inventor: John J. Cremo, 104 Oak St., Portland, Me. 04104

[21] Appl. No.: 63,439

[22] Filed: Aug. 3, 1979

[51] Int. Cl.[3] ..... B01D 47/08; F23J 15/00

[52] U.S. Cl. ..... 55/230; 55/260; 55/263; 55/422; 261/88; 261/118; 261/126; 261/DIG. 9; 110/119; 110/215; 110/216

[58] Field of Search ..... 55/230, 260, 263, 422; 261/17, 88, 118, 126, DIG. 9; 110/119, 215, 216

[56] References Cited

U.S. PATENT DOCUMENTS

| | | | |
|---|---|---|---|
| 544,865 | 8/1895 | Peterson | 55/263 |
| 1,065,985 | 7/1913 | Swem | 261/17 |
| 1,604,769 | 10/1926 | Fox | 261/DIG. 9 |
| 2,709,580 | 5/1955 | Kameya | 261/118 |
| 2,937,013 | 5/1960 | Fisher | 261/17 |
| 3,290,024 | 12/1966 | Huber | 261/88 |
| 3,387,432 | 6/1968 | Ferrara | 55/263 |
| 3,487,620 | 1/1970 | Klein et al. | 55/263 |
| 3,518,817 | 7/1970 | Dell'agnese et al. | 55/260 |
| 3,530,647 | 12/1970 | Wetzel | 55/263 |
| 3,548,761 | 12/1970 | Zalassan | 55/263 |
| 3,853,515 | 12/1974 | Davis | 55/230 |
| 4,019,882 | 4/1977 | Herrera | 261/17 |

FOREIGN PATENT DOCUMENTS

| | | | |
|---|---|---|---|
| 743172 | 3/1933 | France | 55/260 |
| 575293 | 4/1958 | Italy | 55/260 |
| 379266 | 7/1973 | U.S.S.R. | 55/230 |

*Primary Examiner*—David L. Lacey
*Attorney, Agent, or Firm*—LaForest S. Saulsbury

[57] ABSTRACT

A steam-pressured eliminator for use on top of a tall, industrial-type, brick or metal smoke stack to reduce their pollution of the atmosphere. This eliminator is operated by pressurized steam directed so as to intercept the flow of smoke tending to leave the stack and releases to the atmosphere only cleansed smoke and steam. The steam condensate with the smoke particles are drained off from the stack attached vessel. The smoke eliminator is such that the eliminator can be assembled to the stack as a unit, as by the use of a helicopter, and in some forms the steam generator is made a part of the unit so as to be inserted in the stack suspended from the top thereof and be heated by the hot gases of the stack itself. Preferably when the stacks are of brick the attachment is made to top and exterior surfaces thereof. When the stacks are of metal the unit can be wedged into the top opening of the stack and the unit vessel being tapered, can be fitted to various diameter sized stacks. A collapsible steam generator of tapered sleeve parts is provided to compact the unit at times it is being handled by the helicopter and make it more easy to insert or install in the stack. A rain collection vessel is provided in one form into which a supply of water can be poured from the helicopter hovering thereover when not kept filled by rain water.

4 Claims, 8 Drawing Figures

STEAM-PRESSURED SMOKE ELIMINATOR FOR TALL SMOKE STACKS

This invention relates to a steam pressured smoke eliminator adapted for use upon tall, industrial-type smoke stacks of either brick or metal.

It is the principal object of the present invention to provide a smoke eliminator adapted for use on tall stacks that can be installed as self-contained units along with their steam generators within the top opening of the stack by the use of helicopters without need of workmen to ascend the stack or to alter its normal construction.

It is still another object of the invention to provide a smoke eliminator which will have its own steam generator as well, along with the smoke particle separating vessel, and all installed therein as a unit so that by merely dropping it into the stack the unit is ready for use and adapted to be serviced with water for the generation of steam by rain collection or by water being poured from a helicopter.

It is further the object of the invention to provide a steam-pressured smoke eliminator that will include a collapsible steam generator that can be extended in the stack once the smoke eliminator has been placed upon the stack top, but can be collapsed prior to unit being removed from the stack, this being done by a cable chain release connected to the helicopter, and that carries a plug that will close the water intake hole when the unit and chain is released from the helicopter.

Still further objects of the invention are to provide a steam-pressured helicopter mountable smoke eliminator for tall brick and metal stacks having the above objects in mind, which is of simple and rugged construction and provide a shoulder adapted to rest on the top face of the tall brick stacks and is tapered to fit into metal stacks of varying diameters for support therein, has a pleasing appearance, easily serviced by helicopter, no wearable parts, inexpensive to manufacture and efficient in operation.

Figures 1, 2, 3, 4, 5:
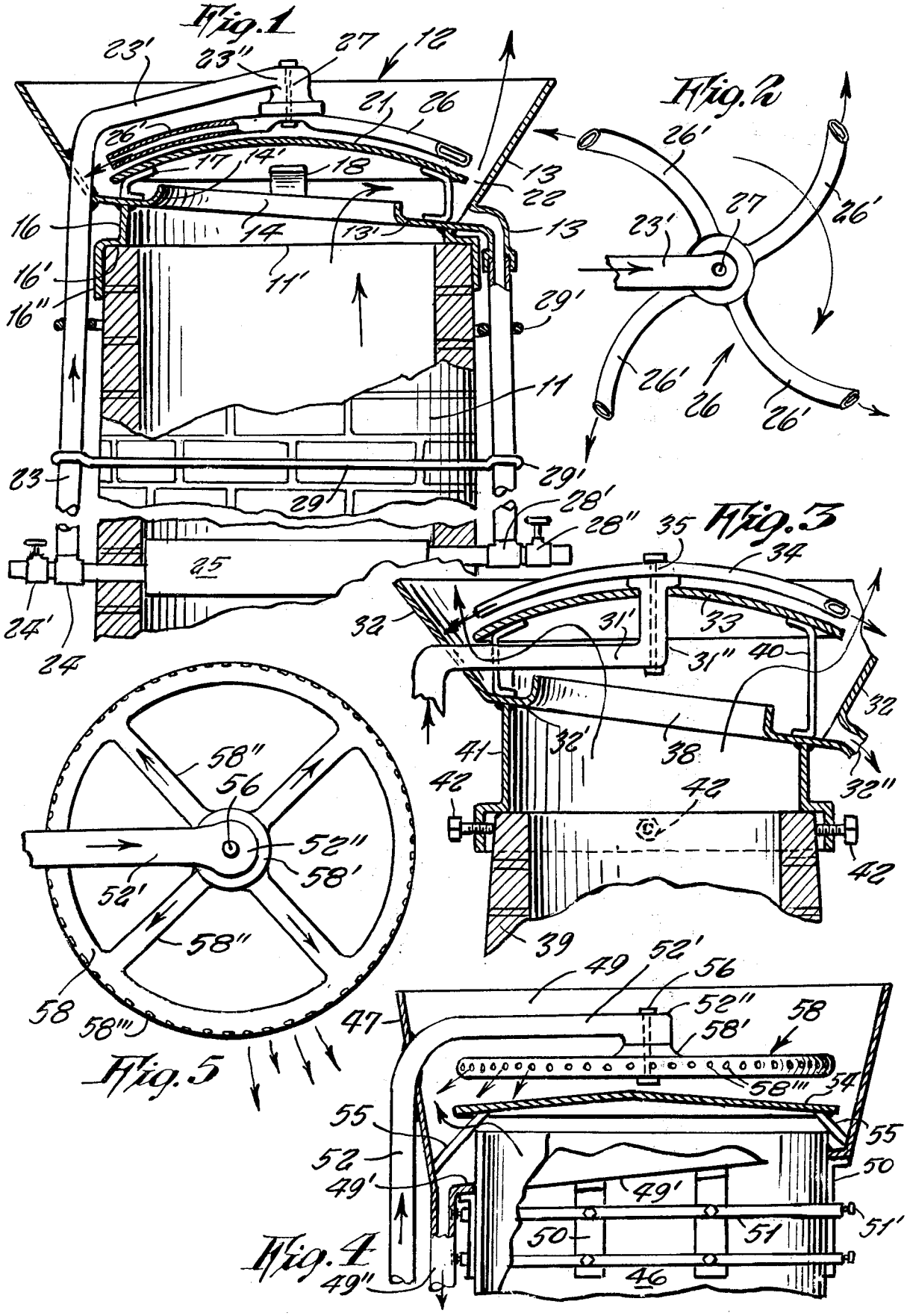
Figure 6:
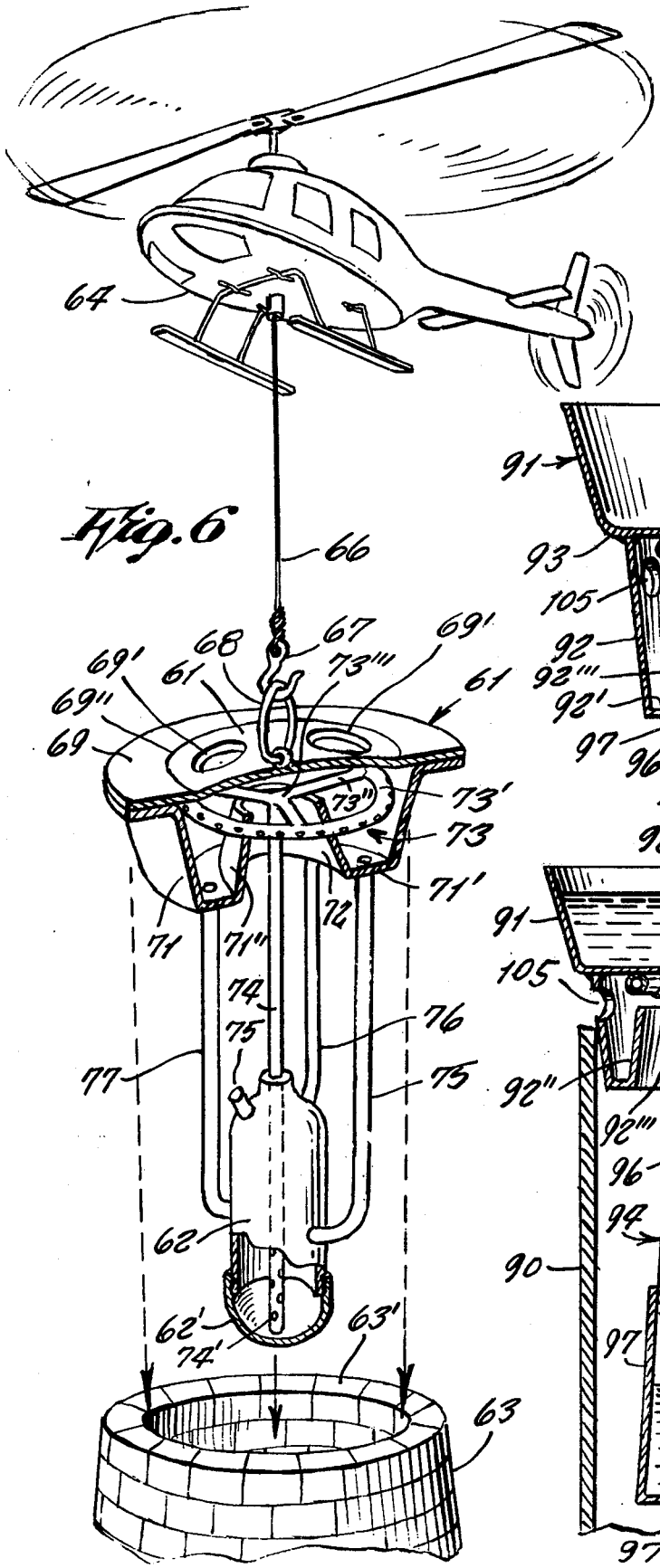
Figure 8:
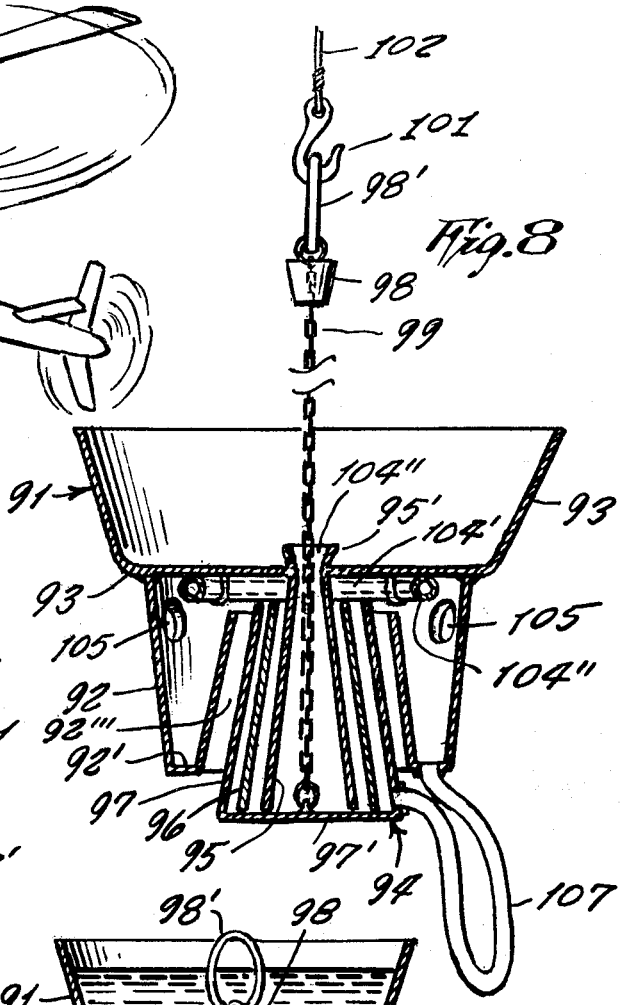
Figure 7:
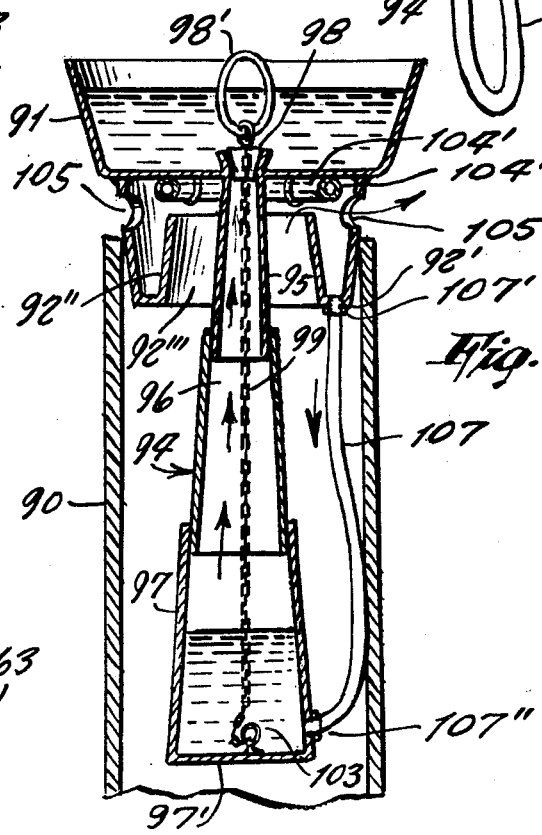

For a better understanding of the invention, reference may be had to the following detailed description taken in connection with the accompanying drawing, in which FIG. 1 is a fragmentary elevational view of the top of an industrial-type brick smoke stack and with a smoke eliminator, constructed according to one form of the invention, mounted thereon, portions of both the stack and smoke eliminator being broke away to show the interior thereof, a steam generator being separately installed in the stack, FIG. 2 is a top plan view of the steam-operated star wheel and of a fragment of the steam delivery pipe on which the star wheel is journaled, FIG. 3 is a fragmentary elevational view of a smoke eliminator similar to FIG. 1, constructed according to another form of the invention, but differing from the first form only by the steam pipe passing through the vessel flaring beneath the baffle and upward through the baffle, the same star wheel of FIG. 2 being journaled upon the pipe end, FIG. 4 is a fragmentary elevational view of a smoke eliminator constructed according to still another form of this invention and in which the eliminator is adapted for installation down over the top of a metal stack and using the stationary perforated steam spray ring of FIG. 5, FIG. 5 is a top plan view of the steam spray ring of FIG. 4 and of a fragment of the bent steam delivery pipe end to which the spray ring is fixed, FIG. 6 is a collective and perspective view of a fragment of a brick stack, a smoke eliminator that carries its own steam generator that will be extended down into the stack for contact with hot gases, and a hovering helicopter from which the eliminator is suspended by a cable, the eliminator being constructed according to a further form of the invention and one that is rested flush upon the stack top and lying substantially fully therewithin, FIG. 7 is a fragmentary elevational and sectional view of a smoke eliminator constructed according to a still further form of the invention, in which the eliminator carries a steam generator that is formed of collapsible tapered sleeves retained collapsed and releasable from a helicopter by a cable chain and has an open vessel to collect rain water and water poured from a hovering helicopter, FIG. 8 is an enlarged vertical sectional view of the smoke eliminator of FIG. 7 with the eliminator removed from the stack by a helicopter and steam generator tapered sleeves collapsed and so held by its chain, as in the process of being transported by the helicopter.

Referring now particularly to FIGS. 1 and 2, there is shown a fragment of a tall, industrial-type brick smoke stack 11 open along a top face line 11'. Mounted flush upon the vary top of the stack is a steam-pressured smoke eliminator indicated generally at 12. This eliminator 12 comprises generally an upwardly and outwardly flared vessel 13 overlying the stack tip face 11' and a shouldered attaching ring welded to an inclined bottom 13' of the flared vessel 13. The inclined vessel bottom 13' has a central opening 14 with a short upwardly-extending flaring 14' running therearound. A stack attaching ring 16 has a horizontally-extending shoulder portion 16' that rests flat upon the stack top face 11' and outwardly of which there extends downwardly an external skirt or sleeve portion 16'' that fits close about the outer surface of the stack 11.

Different height supports 17, 18, 19 and one other support, not shown, are fixed to the inclined vessel bottom 13' at spaced locations therearound and fixedly support a rounded baffle 21 having an upwardly concaved undersurface. This baffle undersurface deflects smoke rising through vessel bottom opening 14 laterally over the bottom opening flaring 14' between the baffle supports toward the the side of the vessel 13 and turning upwardly into space 22 therealong.

A steam delivery pipe 23 runs up one side of the brick stack 11 from a fitting 24 on the outer end of a steam generator 25 that has been installed in stack 11 to be heated by the hot gases passing up the stack 11. The fitting 24 has a valve 24' which when opened allows supply water to pass from a connected hose into the steam generator 25. The upper end 23' of the steam pipe 23 is bent to extend inwardly through the side of the vessel to a point above the center of the baffle 21. The pipe end terminates with a distributing heat 23'' to which a steam jet-operated star wheel 26 is journaled by its hub 26' and a vertical shaft 27.

As seen best in FIG. 2, this steam jet-operated star wheel steam spray head device 26 has radially-extending curved spout arms 26''. Steam jets from inclined cut outer open ends of the arms 26'' causes the star wheel 26 to spin and dispense a sheet-like layer of steam over the outer periphery of the baffle 21 into space 22 and toward the side of the flared vessel 13 and intercepting the smoke rising therein. Solid particles of smoke and ash are wetted down and will accumulate with steam condensate into the inclined vessel bottom 13'. The condensate with the particles is drained off through drain spout 13" and drain pipe 28 to fitting 28' on the steam generator 25 in stack 11 for return thereto or drained off altogether through valve 28" on fitting 28'. The steam delivery and drain pipes 23 and 28 are respectively located at diametrically-opposite sides of the stack 11 and held thereon by clamps 29' on a series of vertically-spaced band rings 29 surrounding the stack. The stack smoke is thereby ridded of smoke particles and is thus cleansed before it is allowed to pass to the atmosphere.

In FIG. 3, there is shown a very similar construction to that shown in FIG. 1 except that a delivery pipe 31 is extended laterally at 31' through a flared vessel 32 below a rounded baffle 33 and upwardly to provide a bearing support 31" for a steam jet-operated star wheel or steam spray head device 34 having a hub 34' and steam jet arms and journaled to the support 31" by vertical shaft 35. Steam under pressure is spread, with the rotation of the star wheel 34, off the edge of the rounded baffle into surrounding space 36 toward the flared vessel.

The flared vessel 32 has an inclined bottom 32' with a large upwardly flared opening 38 through which smoke from brick stack 39 passes and is deflected laterally by baffle 33 toward space 36 where the smoke is intercepted by jetted steam from star wheel 34 and is cleansed in the manner described above. The baffle 33 is supported on inclined vessel bottom 32' by different height brackets 40. The vessel 32 has a shoulder ring 41 welded to its bottom 32'. This ring 41 lies flush across the stack top and depends downwardly to be held in place on the stack by screw clamps 42. The steam condensate with the smoke particles is drained off the vessel bottom 32' by the vessel spout 32" to be used again for steam or delivered to a sewer.

Referring now to FIGS. 4 and 5, there is shown a smoke elimintor 47 which differs from the above-described eliminators in that this eliminator 47 is adapted to be mounted upon a metal stack 46 instead of brick ones. A flared vessel 49 fits down over the outer surface of the stack leaving a full bottom opening in its inclined bottom 49' to span the stack. The inclined vessel bottom 49' is supported on shouldered vertically-extending brackets that are held in place on the stack by vertically-spaced clamp rings surrounding the stack 46 and secured thereto by screw clamps 51'. This clamping assemblage may be made unnecessary by welding the bottom 49' to the metal stack.

A baffle 54 extends over the full extent of the stack and is supported from the flared vessel by inclined brackets 55 that can bear upon the top edge of the stack and removably support the eliminator upon the stack free of the external bracket assemblage with the baffle 54 still vertically-spaced from the stock top edge. Special tackle would be used by the helicopter to install or remove this eliminator 47.

A steam delivery pipe 52 is bent laterally to provide a horizontal arm 52' and a head 52" to which is rigidly secured by bolt 56, a steam jet spray ring structure 58, FIG. 5. This spray ring structure 58 has a hollow hub 58' for distributing steam to four angularly-spaced spokes 58" running radially from the hub 58' to the perforated ring 58'" that is substantially the diameter of the baffle 54 and that dispenses steam through its holes into space 59 and against the flared vessel to intercept smoke passing between inclined baffle support brackets 55 and from under the peripheral edge of the baffle 54. Smoke particles are removed from the smoke and condensate containing them will flow from the vessel bottom 49' down its integral spout 49" on the same side of stack 46 as the steam delivery pipe 42. The pipe 52 and spout 49" can be connected to a steam generator installed in the stack to be heated by its hot gases in the manner shown in FIG. 1. The steam generator, of course, can be separate from the stack and heated in some other manner.

In FIG. 6, there is shown a smoke eliminator 61 that carries its own steam generator 62 so that there is now provided a self-contained unit complete with the generator, and as such, a unit that can be installed in a brick stack 63 by helicopter 64 hovering thereover and upon its stack top surface 63'. The eliminator and generator unit will rest free on the stack and held under their weight with the suspended steam generator located well down into the stack so as to be heated by its hot gases.

The helicopter 64 has a depending cable 66 with a hook 67 that receives a closed chain link or loop 68 connected by an eye to a rounded and flat flanged top cover plate 69 with cleansed smoke exit holes 69'. The eliminator 61 its steam generator 62 are lowered as a unit into brick stack 63. Secured to the underside of top cover plate 69 is a tapered or flared vessel 71 with a vessel bottom 71' and has a peripheral flange 71" by which the eliminator can rest upon top face 63' of stack 63. This vessel bottom 71' has central smoke opening 72 surrounded by an upwardly and inwardly tapered flaring wall 71" through which the stack smoke flows freely upwardly against the underface of the cover plate 69 that serves as a baffle to cause the smoke to be directed outwardly toward the flared vessel into space where the smoke mixes with mixes with delivered steam from a perforated ring structure 73 and precipitates the smoke particles so that only cleansed smoke and steam flow out exit holes 69' in cover plate 69.

The steam spray ring structure 73 has a spray ring 73' with perforations therein and the ring extends around the outer ends of radically-extending spoke tubes 73" that extend from a steam distributing head 73'". The spoke tubes 73" rest on the top edge of the vessel smoke opening flaring 71" and depending from the head 73'" is a steam delivery pipe 74 that is connected to steam generator 62.

Steam condensate and the smoke particles ridded from the stack collect in the vessel bottom 71' and are drained off through rigid drain pipes 75, 76 and 77 connected to exterior of the generator at equally spaced locations therearound and to deposit the steam condensate in the generator for re-use of the water. The drain pipes provide a rigid cage-like support for the generator positioned upon the vessel 71. The smoke particles will gradually build up in the bottom of the generator and at times the eliminator 71 will be lifted by a helicopter from the stack and taken to the ground where bottom cap 62' of the generator will be removed and the generator cleaned of the accumulated smoke particles and the generator replenished with a new supply of water through a filling water inlet 75. The steam delivery pipe 74 extends into the generator and its lower end has perforations 74' to receive the generated steam. This operation of mounting the eliminator on the stack can be done easily by the helicopter, a recognized work horse of today's technology. This smoke eliminator 61 is self-contained unit and by the helicopter easily can be taken from stack to stack. Where the stack smoke may be noted to be heavy, such an eliminator can be planted quickly upon the stack. This operation can be added to already numerous helicopter operations. A city service for this work purpose may be set up.

In FIGS. 7 and 8, there is shown a smoke eliminator 91 that is more adaptable for handling by a helicopter in which the steam generator can be collapsed to shorten the overall length when being transported by the helicopter and to make easier its insertion in the stack. The steam generator can be supplied with water by rain and by pouring into a top vessel water from a helicopter hovering over the stack. A tapered vessel permits installation into various diameter metal stacks.

This smoke eliminator 91 has a tapered bottom vessel 92 which when dropped into a thin wall metal stack 90, is wedged and retained therein up to distance short of its full flaring. This flared vessel 92 has a narrow ring-shaped bottom 92' with a central smoke opening 92''' defined by an upstanding inwardly-tapered internal sleeve flaring 92''. A larger similar-flared vessel 93 is secured to the top of the first vessel 92 and has a closed bottom 93 and serves to collect rain water and water poured from the helicopter. This larger vessel 93 overlies the width of the stack 90 and its closed bottom 93' serves as the smoke baffle for the unit.

Suspended from large vessel bottom 93' down through central opening 92''' surrounded by the flaring 92'' is a collapsible steam generator indicated generally at 94 and comprising tapered sleeves 95, 96 and 97. The small inner tapered sleeve 95 extends centrally upwardly through the top vessel bottom 93' and welded thereto to support the generator. The intermediate tapered sleeve 96 overlies the inner sleeve 95 and its top diameter, while larger than the top diameter of the inner sleeve 95, is smaller than the bottom diameter thereof so as to be tightly secured thereto when the intermediate sleeve 96 is downwardly extended. The outer tapered sleeve 97 overlies the intermediate sleeve and its top diameter, while larger than the top diameter of the intermediate sleeve 96, is smaller than the bottom diameter thereof so as to be tightly secured thereto as the outer tapered sleeve 97 is downwardly extended. This outer sleeve 97 has closed flat bottom 97' that is struck by the hot gases as they ascend the stack and flow about the downwardly extended sleeves to create the steam from the water in the generator.

The upper end of the inner sleeve 95 lying above the vessel bottom 93' is flared at 95' to provide a valve seat for a closure plug 98 fixedly carried on a lift chain cable 99 that will seat in the flaring 95' to close off the extended steam generator 94, FIG. 7. The plug 98 is located on the chain cable at a measured distance so that the seat flaring 95' will remain closed under the weight of the intermediate and outer sleeves 96 and 97 and the steam pressure created itself tending to further downwardly extend the parts. The intermediate sleeve 96 comes to stop over larger bottom of the inner sleeve 95 and the outer sleeve 97 comes to stop over the larger bottom of the intermediate sleeve 96.

Plug 98 has an enlarge loop 98' that can be picked up by helicopter hook 101 and cable 102. The chain 99 is secured at its lower end to the flat bottom 97' so that the helicopter can lift the plug to allow collected water in top vessel 93 to pass over flared seat 95' into the steam generator to replenish it with water for further use. By further pull on chain cable 99 the steam generator sleeves will be collapsed upon one another and lifted into the internal central flaring 92'' of the tapered vessel 92 as seen in FIG. 8 and with still further lift the smoke eliminator 91 will lifted from the metal stack 90 for transport by the helicopter to other locations.

Secured to the underface of bottom 93' of the top upwardly and outwardly flared vessel 93 by clamps 104' is a perforated steam jet spray ring or head 104 of a steam spray head that is supplied with live steam by radially-extending angularly-spaced tubes 104'' connected to the steam generator inner sleeve 95 just under the vessel bottom to receive steam therefrom. From the spray ring perforations, steam under pressure is directed downwardly toward the bottom tapered vessel flaring below side openings 105 circumferentially-spaced therearound. This steam intercepts the smoke moving laterally over the upper edge of internal flaring 92'' toward the side openings 105. The smoke will be cleansed of smoke particles and the steam condensate with the particles will be collected in the vessel bottom 92' and drained off by a flexible metal flame-resistant hose 107 coupled between the vessel bottom 92' at 107' and at a low point 107'' in the side of the outer generator sleeve 97 whereby the water condensate will again be turned into steam and recycled while the particles will collect in the bottom of the steam generator. At periods of time, the eliminator 91 will be removed from the stack by the helicopter and taken to a ground rack for washout and general cleaning. With the helicopter always available the task of serving the eliminators will be simple. This eliminator may provide an instrument by which the efficiency of the stack and some measurement of its smoke pollution to the atmosphere can be determined.

It should be apparent now that there has been provided a smoke eliminator for tall, industrial-type smoke stacks that can be easily installed in the top of stacks by the use of the helicopter and serviced thereby and that is operated by steam under pressure. That a portable self-contained smoke eliminator adapted for either brick or metal stacks has been provided and has its own steam generator has been provided. That the eliminator can be compacted by the use of a collapsible steam generator and supplied with water for steam by the rain or by pouring water thereinto from a hovering helicopter. That by the use of tapering main vessel the eliminator can be fitted into varying diameter stacks.

While various changes may be made in the detail construction, it shall be understood that such changes shall be made within the spirit and scope of the invention as defined by the above appended claims.

What is claimed is:

1. A self-contained, steam-pressured smoke eliminator adapted to be lowered as a unit by a helicopter into the top opening of a tall industrial-type smoke stack comprising a tapered vessel member releasably engageable with the stack wall for the support of the eliminator in the smoke stack, said tapered vessel member having a bottom wall with an enlarged central opening and an upwardly-extending peripheral flaring thereabout upwardly through which the smoke from the stack is passed, a baffle and cover member spaced above the peripheral flaring and connected to the tapered vessel member to laterally deflect the smoke leaving the top of upwardly-extending peripheral flaring, a steam generator unit supported from one of said members and adapted to depend into the smoke stack to be heated by the hot gases ascending the stack, a steam spray head member connected to one of the members and connected to the steam generator to direct steam into the deflected path of the smoke from the vessel opening and its flaring and into space overlying the wall of the tapered vessel member and drain means extending from the bottom of the tapered vessel for draining off the smoke condensate collected therein and one of said members having an opening for the exit of the cleaned smoke to the atmosphere.

2. A self-contained, steam-pressured smoke eliminator adapted to be lowered as a unit by helicopter into the top opening of an industrial-type smoke stack as defined in claim 1, and grapple means connected to said baffle and cover member adapted to be releasably engaged by a complementary grapple means suspended from a helicopter when used for insertion of the smoke eliminator into the top opening of the tall smoke stack and its removal therefrom.

3. A self-contained steam-pressured smoke eliminator adapted to be lowered as a unit by a helicopter into the top opening of a tall industrial-type smoke stack as defined in claim 1 and said depending steam generator unit comprising a plurality of vertically-arranged extendable tapered sleeves telescopingly connected together, the lower extendable sleeve having a closed bottom to contain water used for the generation of the steam, grapple means adapted to be releasably engaged by a complementary grapple means suspended from a helicopter and having a lifting cable, said lifting cable being connected to the lower extendable tapered sleeve and extending upwardly through the smoke eliminator members to collapse the generator sleeves into the members upon the smoke eliminator being lifted by the helicopter and its lifting cable whereby the overall length of the smoke eliminator with its steam generator will be shortened from a helicopter by its insertion into the smoke stack while being suspended from a helicopter.

4. A self-contained, steam-pressured smoke eliminator adapted to be lowered as a unit by a helicopter into the top opening of a tall, industrial-type smoke stack as defined in claim 3 and said baffle and cover member being provided with an enlarged open top side wall to contain water collected from rain or poured thereinto by a servicing helicopter, said generator sleeves being tapered to support themselves when extended, the upper one of said generator sleeves extending through the baffle and cover member and having a valve seat therein, said lifting cable extending downwardly through the valve seat with the collapsible generator sleeve and connected to the bottom of the lower extendable sleeve, a valve plug carried by the lifting cable and engagable with the valve seat when the generator sleeves are downwardly extended to seal off the generator and allow for the accumulation of water in the baffle and cover member but liftable by a helicopter to permit the replenishing of the steam generator with water from the open top side wall of the baffle and cover member.

* * * * *